US011555248B2

(12) United States Patent
Li et al.

(10) Patent No.: US 11,555,248 B2
(45) Date of Patent: Jan. 17, 2023

(54) COLD SPRAYING

(71) Applicant: ROLLS-ROYCE plc, London (GB)

(72) Inventors: Feng Li, Singapore (SG); Iulian Marinescu, Singapore (SG); Adrian W Y Tan, Singapore (SG); Sun Wen, Singapore (SG); Erjia Liu, Singapore (SG)

(73) Assignee: Rolls-Royce PLC, London (GB)

( * ) Notice: Subject to any disclaimer, the term of this patent is extended or adjusted under 35 U.S.C. 154(b) by 0 days.

(21) Appl. No.: 17/125,270

(22) Filed: Dec. 17, 2020

(65) Prior Publication Data

US 2021/0207271 A1 Jul. 8, 2021

(30) Foreign Application Priority Data

Jan. 6, 2020 (GB) ..... 2000103

(51) Int. Cl.

| | |
|---|---|
| ***C23C 24/04*** | (2006.01) |
| ***C23C 28/02*** | (2006.01) |
| *C23C 28/00* | (2006.01) |
| *C23C 24/08* | (2006.01) |

(52) U.S. Cl.

CPC ..... *C23C 24/04* (2013.01); *C23C 28/021* (2013.01); *C23C 24/08* (2013.01); *C23C 24/082* (2013.01); *C23C 24/085* (2013.01); *C23C 24/087* (2013.01); *C23C 28/023* (2013.01); *C23C 28/30* (2013.01); *C23C 28/32* (2013.01); *C23C 28/321* (2013.01); *C23C 28/322* (2013.01); *C23C 28/34* (2013.01); *C23C 28/345* (2013.01)

(58) Field of Classification Search

CPC ..... C23C 24/04; C23C 24/08; C23C 24/082; C23C 24/085; C23C 24/087; C23C 28/02; C23C 28/021; C23C 28/023; C23C 28/30; C23C 28/32; C23C 28/321; C23C 28/322; C23C 28/34; C23C 28/345

USPC ..... 427/427, 446

See application file for complete search history.

(56) References Cited

U.S. PATENT DOCUMENTS

| | | | | |
|---|---|---|---|---|
| 7,476,422 | B2 * | 1/2009 | Elmoursi | H05K 3/245 427/446 |
| 2002/0073982 | A1 | 6/2002 | Shaikh et al. | |
| 2002/0102360 | A1 | 8/2002 | Subramanian et al. | |
| 2007/0098913 | A1 * | 5/2007 | Raybould | C23C 24/04 427/446 |
| 2008/0254227 | A1 * | 10/2008 | Stoltenhoff | C23C 4/02 427/447 |

(Continued)

FOREIGN PATENT DOCUMENTS

| | | | |
|---|---|---|---|
| EP | 2537959 | A1 | 12/2012 |
| EP | 2789713 | A1 | 10/2014 |

OTHER PUBLICATIONS

Great Britain search report dated Jun. 29, 2020, issued in GB Patent Application No. 2000103.8.

(Continued)

*Primary Examiner* — Brian K Talbot

(74) *Attorney, Agent, or Firm* — Shumaker & Sieffert, P.A.

(57) ABSTRACT

A method comprising: cold-spraying a surface of a substrate with a bond material to form a bond coating; and cold-spraying a surface of the bond coating with a coating material to form a top coating. The bond material is different from the coating material and harder than the surface of the substrate.

13 Claims, 6 Drawing Sheets

(56) References Cited

U.S. PATENT DOCUMENTS

| | | | | |
|---|---|---|---|---|
| 2010/0201228 | A1* | 8/2010 | Zahiri | C23C 24/04 310/365 |
| 2013/0177437 | A1* | 7/2013 | Amancherla | C23C 4/02 416/241 R |
| 2013/0177705 | A1* | 7/2013 | Calla | C23C 24/04 427/201 |
| 2014/0023875 | A1* | 1/2014 | Hirano | C23C 28/42 427/205 |
| 2014/0069700 | A1* | 3/2014 | Hirano | C23C 28/023 174/257 |
| 2015/0251196 | A1* | 9/2015 | Hirano | B05B 7/1481 427/180 |
| 2016/0149195 | A1* | 5/2016 | Yamauchi | H01M 50/543 427/456 |
| 2016/0156013 | A1* | 6/2016 | Yamauchi | B32B 15/015 427/180 |
| 2018/0298498 | A1* | 10/2018 | Araki | B32B 15/015 |
| 2018/0315680 | A1* | 11/2018 | Aikawa | B22F 9/082 |
| 2019/0329906 | A1* | 10/2019 | Cawthorne | B64C 11/205 |

OTHER PUBLICATIONS

Extended European Search Report from counterpart EP Application No. 20214488.7 dated Feb. 8, 2021, 7 pgs.

* cited by examiner

COLD SPRAYING

CROSS-REFERENCE TO RELATED APPLICATIONS

This specification is based upon and claims the benefit of priority from United Kingdom patent application number GB 2000103.8 filed on Jan. 6, 2020, the entire contents of which is incorporated herein by reference.

BACKGROUND

Technical Field

The present disclosure concerns methods relating to cold-spraying and structural components manufactured or repaired using such methods.

Description of the Related Art

Cold-spraying is a method for spray-coating a substrate with a powdered coating material. The powdered material is accelerated towards the substrate in a supersonic gas jet under such conditions that the powdered material does not melt during the spraying process. On impact with the substrate, the particles of the powdered material deform plastically, particularly through adiabatic shearing, causing the powdered material to flow locally and bond with the substrate.

Cold-spraying has been used to spray-coat substrates with metals and with ceramics, for example to achieve dimensional restoration of damaged structural components for machines (such as damaged engine blocks). However, cold-sprayed coatings do not always adhere well. Achieving good adhesion when cold-spraying coatings onto certain types of substrates (such as cast iron substrates) has been found to be particularly difficult.

SUMMARY

According to a first aspect, there is provided a method comprising the steps of: cold-spraying a surface of a substrate with a bond material to form a bond coating; and cold-spraying a surface of the bond coating with a coating material to form a top coating; wherein the bond material is (a) different from the coating material and (b) harder than the surface of the substrate.

The inventors have found that cold-spraying the substrate with the bond material to form the bond coating, prior to cold-spraying the surface of the bond coating with the coating material to form the top coating, results in improved adhesion of the top coating to the substrate, particularly in comparison to cold-spraying the surface of the substrate directly with the coating material. Without wishing to be bound by theory, the inventors posit that, because the bond material is harder than the surface of the substrate, the surface of the substrate is deformed plastically during cold-spraying the bond material, leading to mechanical interlocking of the substrate and the bond material.

It may be that the bond material is harder than the coating material. The improvement in adhesion of the top coating to the substrate (in comparison to cold-spraying the surface of the substrate directly with the coating material), which is achieved by cold-spraying the substrate with the bond material to form the bond coating prior to cold-spraying the surface of the bond coating with the coating material to form the top coating, may be enhanced when the bond material is harder than the coating material. For example, adhesion may be relatively poor when cold-spraying relatively softer materials onto certain types of substrate (for example, substrates comprises non-metallic, intermetallic, ceramic or oxide phases), but this adhesion may be improved by first cold-spraying the surface of the substrate with the harder bond material. As discussed hereinabove, cold-spraying the surface of the substrate with the harder bond material may lead to good adhesion between the bond coating and the substrate due to plastic deformation of the substrate and mechanical interlocking of the bond material and the substrate. In addition, the inventors have found that the top-coat adheres more strongly when cold-sprayed onto the bond coat than when cold-sprayed directly onto the surface of the substrate.

It will be appreciated that the hardness of a material or a surface may be characterised by many different methods, such as by scratch hardness testing (for example, on the Mohs scale), by indentation hardness testing (for example, on the Rockwell, Vickers, Shore or Brinell scales), or by rebound hardness testing (for example, using the Loeb rebound hardness test).

It may therefore be that the hardness of the surface of the substrate, the bond material and/or the coating material is the indentation hardness of the said surface of the substrate, bond material and/or coating material. In particular, it may be that the hardness of the surface of the substrate, the bond material and/or the coating material is a Vickers hardness of the said surface of the substrate, bond material and/or coating material.

It may be that a difference between the Vickers hardness of the bond material and the Vickers hardness of the surface of the substrate is at least 100 HV, for example at least 150 HV, when measured under the same conditions. The inventors have found that adhesion is particularly enhanced when the difference between the Vickers hardness of the bond material and the Vickers hardness of the surface of the substrate is at least 100 HV, for example at least 150 HV.

Additionally or alternatively, it may be that a difference between the Vickers hardness of the bond material and the Vickers hardness of the coating material is at least 100 HV, for example at least 150 HV, when measured under the same conditions.

It will be appreciated that cold-spraying is a method for spray-coating a substrate with a material. In particular, cold-spraying involves spraying the substrate with powdered material which is accelerated in a supersonic gas jet under such conditions that the powdered material does not melt during the spraying process (i.e., particles of the powdered material are solid immediately prior to impacting the substrate). On impact with the surface, the particles of the powdered material deform plastically, particularly through adiabatic shearing, causing the powdered material to flow locally and bond with the substrate. Cold-spraying may be high-pressure cold-spraying (HPCS), which makes use of working gas pressures above about 1.5 MPa (and commonly up to about 7.0 MPa) and working gas pre-heated temperatures up to about 1100° C., or low-pressure cold-spraying (LPCS), which makes use of working gas pressures from about 0.5 MPa to about 1.0 MPa and working gas pre-heated temperatures lower than about 550° C. HPCS is particularly suitable for cold-spraying metals requiring higher critical velocities, such as Ti-based alloys or Ni-based superalloys. LPCS is particularly suitable for cold-spraying metals requiring lower critical velocities, such as Al-based or Cu-based alloys.

The substrate may comprise a material comprising a non-metallic, intermetallic, ceramic or oxide phase. For example, it may be that the substrate consists of (e.g. is formed from) the material comprising the non-metallic, intermetallic, ceramic or oxide phase. It may be that a portion of the substrate comprises (e.g. consists of or is formed from) the material comprising the non-metallic, intermetallic, ceramic or oxide phase. The portion of the substrate (which comprises (e.g. consists of or is formed from) the material comprising the non-metallic, intermetallic, ceramic or oxide phase) may be a surface portion of the substrate (for example, the surface of the substrate, and optionally a portion of the substrate extending away from the surface into a body of the substrate). Cold-spraying the bond material to form the bond coating prior to cold-spraying the coating material to form the top coating may be particularly effective in enhancing adhesion of the top coating to the substrate when the substrate (e.g. a portion of the substrate, such as a surface portion of the substrate) comprises (e.g. consists of or is formed from) a material comprising a non-metallic, intermetallic, ceramic or oxide phase. It can otherwise be difficult to cold-spray certain types of material (for example some relatively softer metals, such as nickel or nickel-based alloys) onto non-metallic, intermetallic, ceramic or oxide phases.

The term "intermetallic" will be understood as encompassing traditionally-defined intermetallic compounds (such as $Ni_3Al$) and interstitial compounds (such as $Fe_3C$). The grouping "non-metallic, intermetallic, ceramic or oxide phases" therefore includes carbon (for example, in the form of graphite) and cementite ($Fe_3C$) as found in certain ferrous alloys. Ceramic phases include carbides, such as metal carbides (e.g. titanium carbide or tungsten carbide) or non-metal carbides (e.g. silicon carbide). Oxide phases include metal oxides such as aluminium oxide ($Al_2O_3$) or iron oxides (FeO, $Fe_2O_3$, etc.).

Accordingly, the substrate (e.g. a portion of the substrate, for example a surface portion of the substrate) may comprise (e.g. consist of or be formed from) an alloy which comprises the non-metallic, intermetallic, ceramic or oxide phase. For example, the alloy may have a microstructure comprising two or more different phases, one of the said two or more different phases being the non-metallic, intermetallic, ceramic or oxide phase.

It will be appreciated that some materials may be classified as being more than one of non-metallic, intermetallic, ceramic or oxide phases. For example, a metal oxide is an oxide phase and may also be a ceramic phase. An intermetallic phase may also be a ceramic phase. Accordingly, for the avoidance of doubt, throughout this specification and the appended claims, "a material comprising a non-metallic, intermetallic, ceramic or oxide phase" shall be interpreted as referring to a material which comprises a phase which may be characterised as being a non-metallic and/or intermetallic and/or ceramic and/or oxide phase. That is to say, the "or" in the phrase "non-metallic, intermetallic, ceramic or oxide phase" is not an exclusive "or" but is instead an inclusive "or" (i.e. equivalent to "and/or").

The substrate (e.g. a portion of the substrate, for example a surface portion of the substrate) may comprise (e.g. consist of or be formed from) iron. For example, the substrate (e.g. the portion of the substrate, for example the surface portion of the substrate) may comprise (e.g. consist of or be formed from) a ferrous alloy. The ferrous alloy may be an iron-carbon alloy (it being appreciated that an iron-carbon alloy may include other alloying elements and/or impurities) such as a steel (i.e. an iron-carbon alloy containing no more than about 2.1 wt. % carbon and which generally does not undergo a eutectic reaction on cooling from the melt) or a cast iron (i.e. an iron-carbon alloy containing no less than about 2.1 wt. % carbon and which generally does undergo a eutectic reaction on cooling from the melt). The cast iron may be grey cast iron, white cast iron, malleable cast iron or ductile cast iron. Cold-spraying the bond material to form the bond coating prior to cold-spraying the coating material to form the top coating may be particularly effective in enhancing adhesion of the top coating to the substrate when the substrate (e.g. a portion of the substrate, such as a surface portion of the substrate) comprises (e.g. consists of or is formed from) iron, for example a ferrous alloy such as an iron-carbon alloy such as steel or cast iron. The inventors have found that it can be particularly difficult to achieve good adhesion of coatings when cold-spraying onto cast iron (especially grey cast iron) substrates without use of the bond coating.

It will be appreciated that the bond material being different from the coating material means that that bond material and the coating material have different (i.e. chemical) compositions.

The bond material may comprise (e.g. be) a metal or metal alloy. The metal may be a transition metal and/or the metal alloy may be a transition metal-based alloy (i.e. an alloy based predominantly on a transition metal). By the term "transition metal", a metal selected from the d-block (i.e. groups 3 to 12) of the periodic table of elements will be understood. For example, the bond material may comprise (e.g. consist of) scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold and/or mercury. The bond material may comprise (e.g. consist of) an alloy comprising (e.g. based (i.e. predominantly) on) scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold and/or mercury.

The bond material may comprise (e.g. consist of) cobalt or a cobalt-based alloy. The cobalt-based alloy may contain one or more transition metals in addition to cobalt. For example, the cobalt-based alloy may be a cobalt-chromium (Co—Cr) alloy or a cobalt-chromium-tungsten (Co—Cr—W) alloy.

The bond material may comprise (e.g. consist of) titanium or a titanium-based alloy. The titanium-based alloy may contain one or more metals in addition to titanium. For example, the titanium alloy may be a titanium-aluminium-vanadium (Ti—Al—V) alloy such as Ti-6Al-V.

The bond material may comprise (e.g. consist of) a ceramic. The ceramic may be an oxide, for example a metal oxide. For example, the bond material may comprise (e.g. consist of) aluminium oxide, i.e. alumina ($Al_2O_3$).

The coating material may be a metal or a metal alloy. The metal may be a transition metal and/or the metal alloy may be a transition metal-based alloy. For example, the coating material may comprise (e.g. consist of) scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold and/or mercury. The coating material may comprise (e.g. consist of) an alloy comprising (e.g. based (i.e. predominantly) on) scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold and/or mercury.

The coating may comprise (e.g. consist of) nickel or a nickel-based alloy (e.g. a nickel-based superalloy such as an Inconel® or Renee alloy).

The coating material may comprise (e.g. consist of) a superalloy, for example a nickel-based, iron-based or cobalt-based superalloy.

In some examples: the substrate (e.g. a portion of the substrate, for example a surface portion of the substrate) comprises (e.g. consists of or is formed from) cast iron (e.g. grey cast iron); the bond material comprises (e.g. consists of) a metal or metal alloy (e.g. cobalt or a cobalt-based alloy (e.g. a cobalt-chromium (Co—Cr) alloy or a cobalt-chromium-tungsten (Co—Cr—W) alloy) or titanium or a titanium-based alloy (e.g. a titanium-aluminium-vanadium (Ti—Al—V) alloy such as Ti-6Al-V)) or a ceramic (such as a metal oxide (e.g. alumina ($Al_2O_3$))); and the coating material comprises (e.g. consists of) nickel or a nickel-based alloy (e.g. a nickel-based superalloy such as an Inconel® or Rene® alloy).

In some examples: the substrate (e.g. a portion of the substrate, for example a surface portion of the substrate) comprises (e.g. consists of or is formed from) cast iron (e.g. grey cast iron); the bond material comprises (e.g. consists of) cobalt or a cobalt-based alloy (e.g. a cobalt-chromium (Co—Cr) alloy; and the coating material comprises (e.g. consists of) nickel or a nickel-based alloy (e.g. a nickel-based superalloy such as an Inconel® or Rene® alloy).

In some examples: the substrate (e.g. a portion of the substrate, for example a surface portion of the substrate) comprises (e.g. consists of or is formed from) cast iron (e.g. grey cast iron); the bond material comprises (e.g. consists of) titanium or a titanium-based alloy (e.g. a titanium-aluminium-vanadium (Ti—Al—V) alloy such as Ti-6Al-V), and the coating material comprises (e.g. consists of) nickel or a nickel-based alloy (e.g. a nickel-based superalloy such as an Inconel® or Rene® alloy).

In some examples: the substrate (e.g. a portion of the substrate, for example a surface portion of the substrate) comprises (e.g. consists of or is formed from) cast iron (e.g. grey cast iron); the bond material comprises (e.g. consists of) a ceramic (such as a metal oxide (e.g. alumina ($Al_2O_3$))); and the coating material comprises (e.g. consists of) nickel or a nickel-based alloy (e.g. a nickel-based superalloy such as an Inconel® or Rene® alloy).

It may be that the bond coating is no less than about 0.1 mm thick, for example, no less than about 0.5 mm thick. It may be that the bond coating is no greater than about 2 mm thick, for example no greater than about 1 mm thick. It may be that the bond coating is from about 0.1 mm to about 2 mm thick, for example from about 0.1 mm to about 1 mm thick, or from about 0.5 mm to about 2 mm thick, or from about 0.5 mm to about 1 mm thick.

It may be that the top coating is no less than about 0.5 mm thick, for example, no less than about 2 mm thick, or no less than about 5 mm thick. It may be that the top coating is no greater than about 1 cm thick, for example, no greater than about 5 mm thick, or no greater than about 3 mm thick. It may be that the top coating is from about 0.5 mm to about 1 cm thick, for example, from about 0.5 mm to about 5 mm thick, or from about 0.5 mm to about 3 mm thick, or from about 2 mm to about 1 cm thick, or from about 2 mm to about 5 mm thick, or from about 2 mm to about 3 mm thick, or from about 5 mm to about 1 cm thick.

The method may comprise heating the coated substrate after forming the top coating (i.e. subjecting the coated substrate to a heat treatment). The inventors have found that heating the coated substrate further increases the adhesion of the top coating to the substrate and/or improves the mechanical stability of the coating. Without wishing to be bound by theory, the inventors posit that heating the coated substrate after forming the top coating relaxes residual stresses in the structure and/or promotes diffusion of material which enhances adhesion.

It may be that heating the coated substrate comprises heating the coated substrate for at least 30 minutes, for example, for at least 1 hour, or for at least 2 hours, or for at least 4 hours. It may be necessary to heat the coated substrate for a minimum period of time in order to achieve an enhancement in adhesion (for example, in order to enable sufficient diffusion to take place). It may be that heating the coated substrate (i.e. within the context of the heat treatment) comprises heating the coated substrate for no more than about 1 day, for example, no more than about 12 hours.

It may be that heating the coated substrate comprises holding the coated substrate at a temperature no less than about 200° C., for example, no less than about 300° C., or no less than about 400° C., or no less than about 500° C. It may be that heating the coated substrate comprises holding the coated substrate at a temperature no greater than about 1000° C., for example, no greater than about 900° C., or no greater than about 800° C., or no greater than about 700° C., or no greater than about 600° C., or no greater than about 500° C. It may be that heating the coated substrate comprises holding the coated substrate at a temperature from about 200° C. to about 1000° C., for example from about 200° C. to about 900° C., or from about 200° C. to about 800° C., or from about 200° C. to about 700° C., or from about 200° C. to about 600° C., or from about 200° C. to about 500° C., or from about 300° C. to about 1000° C., or from about 300° C. to about 900° C., or from about 300° C. to about 800° C., or from about 300° C. to about 700° C., or from about 300° C. to about 600° C., or from about 300° C. to about 500° C., or from about 400° C. to about 1000° C., or from about 400° C. to about 900° C., or from about 400° C. to about 800° C., or from about 400° C. to about 700° C., or from about 400° C. to about 600° C., or from about 400° C. to about 500° C., or from about 500° C. to about 1000° C., or from about 500° C. to about 900° C., or from about 500° C. to about 800° C., or from about 500° C. to about 700° C., or from about 500° C. to about 600° C., The method may comprise holding the coated substrate at a temperature at which residual stress relaxation and/or diffusion takes place. However, the temperature at which the coated substrate is held should generally not be sufficiently high as to promote phase transformations (including changes of state (e.g. melting) or solid-solid phase transformations (e.g. changes in crystal structure)) in any of the substrate, bond coating or top coating.

It may be that the method further comprises mechanically preparing the surface of the substrate prior to forming the bond coating. Mechanically preparing the surface of the substrate may comprise (e.g. consist of) grinding, milling or polishing the surface of the substrate, for example to remove material from the surface of the substrate.

The substrate may be a structural component (e.g. a structural component for use in a machine). For example, the substrate may be a vehicle component (i.e. a structural component of a vehicle), for example an automotive component (i.e. a structural component of a motor vehicle). The substrate may be an engine component such as an engine block.

The method may be a method of coating a substrate. The method may be a method of manufacturing a coated substrate. The method may be a method of manufacturing a structural component (e.g. a vehicle component, an automotive component, an engine component or an engine block).

The method may be a method of repairing a structural component (e.g. a vehicle component, an automotive component, an engine component or an engine block). The method may comprise removing (e.g. damaged) material from the substrate (i.e. the structural component) prior to cold-spraying the substrate (i.e. the structural component) to form the bond coating and the top coating. The method of repairing the structural component may result in dimensional restoration of the structural component.

For the avoidance of doubt, the method may be a method of repairing an engine block (for example, a cast iron engine block), the method comprising: removing material from the engine block (e.g. thereby removing a damaged portion of the engine block) to form a surface; cold-spraying the surface with the bond material to form the bond coating; and cold-spraying the surface of the bond coating with the coating material to form the top coating.

In a second aspect, there is provided a structural component (e.g. for a machine) manufactured by the method according to the first aspect. The structural component may be a vehicle component (i.e. a structural component of a vehicle), for example an automotive component (i.e. a structural component of a motor vehicle). The structural component may be an engine component such as an engine block.

In a third aspect, there is provided a structural component (e.g. for a machine) comprising: a body comprising (e.g. consisting of or formed from) a body material comprising a non-metallic, intermetallic, ceramic or oxide phase; and a coating extending across at least a portion of the body, the coating comprising a bond coating formed from a bond material and a top coating formed from a coating material, the bond coating being provided between the body and the top coating, the bond coating being in direct contact with the body material of the body; wherein the bond material is (a) different from the coating material and (b) harder than the body material.

Since the bond coating is in direct contact with the body material of the body, the bond coating may interface with the body (e.g. the body material of the body). The bond coating may also be in direct contact with the top coating. Accordingly, the bond coating may interface with the top coating (e.g. the coating material of the top coating).

The coating may be a cold-sprayed coating. That is to say, the bond coating may be a cold-sprayed bond coating and the top coating may be a cold-sprayed top coating.

The structural component may be a vehicle component (i.e. a structural component of a vehicle), for example an automotive component (i.e. a structural component of a motor vehicle). The structural component may be an engine component such as an engine block. Accordingly, the body may be a vehicle component body, for example an automotive component body. The body may be an engine component body such as an engine block body.

It may be that the bond material is harder than the coating material.

It may be that the hardness of the body material, the bond material and/or the coating material is the indentation hardness of the said body material, bond material and/or coating material. In particular, it may be that the hardness of the body material, the bond material and/or the coating material is a Vickers hardness of the said body material, bond material and/or coating material.

It may be that a difference between the Vickers hardness of the bond material and the Vickers hardness of the body material is at least 100 HV, for example at least 150 HV, when measured under the same conditions. Additionally or alternatively, it may be that a difference between the Vickers hardness of the bond material and the Vickers hardness of the coating material is at least 100 HV, for example at least 150 HV, when measured under the same conditions.

The body may consist of or be formed from the body material comprising the non-metallic, intermetallic, ceramic or oxide phase. It may be that (e.g. at least) a portion of the body (for example, an interfacial portion of the body which interfaces with the bond coating) comprises (e.g. consists of or is formed from) the body material comprising the non-metallic, intermetallic, ceramic or oxide phase. The term "intermetallic" will be understood as encompassing traditionally-defined intermetallic compounds (such as $Ni_3Al$) and interstitial compounds (such as $Fe_3C$). The grouping "non-metallic, intermetallic, ceramic or oxide phases" therefore includes carbon (for example, in the form of graphite) and cementite ($Fe_3C$) as found in certain ferrous alloys. Oxide phases include metal oxides such as aluminium oxide ($Al_2O_3$) or iron oxides (FeO, $Fe_2O_3$, etc.).

The body material may be an alloy which comprises the non-metallic, intermetallic, ceramic or oxide phase. For example, the alloy may have a microstructure comprising two or more different phases, one of the said two or more different phases being the non-metallic, intermetallic, ceramic or oxide phase. The alloy may be a ferrous alloy. The alloy may be an iron-carbon alloy (it being appreciated that an iron-carbon alloy may include other alloying elements and/or impurities) such as a steel (i.e. an iron-carbon alloy containing no more than about 2.1 wt. % carbon and which does not generally undergo a eutectic reaction on cooling from the melt) or a cast iron (i.e. an iron-carbon alloy containing no less than about 2.1 wt. % carbon and which does generally undergo a eutectic reaction on cooling from the melt). The cast iron may be grey cast iron, white cast iron, malleable cast iron or ductile cast iron.

It will be appreciated that the bond material being different from the coating material means that that bond material and the coating material have different (i.e. chemical) compositions.

The bond material may comprise (e.g. be) a metal or metal alloy. The metal may be a transition metal and/or the metal alloy may be a transition metal-based alloy (i.e. an alloy based predominantly on a transition metal). For example, the bond material may comprise (e.g. consist of) scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold and/or mercury. The bond material may comprise (e.g. consist of) an alloy comprising (e.g. based (i.e. predominantly) on) scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold and/or mercury.

The bond material may comprise (e.g. consist of) cobalt or a cobalt-based alloy. The cobalt-based alloy may contain one or more transition metals in addition to cobalt. For example, the cobalt-based alloy may be a cobalt-chromium (Co—Cr) alloy or a cobalt-chromium-tungsten (Co—Cr—W) alloy.

The bond material may comprise (e.g. consist of) titanium or a titanium-based alloy. The titanium-based alloy may contain one or more metals in addition to titanium. For example, the titanium alloy may be a titanium-aluminium-vanadium (Ti—Al—V) alloy such as Ti-6Al-V.

The bond material may comprise (e.g. consist of) a ceramic. The ceramic may be an oxide, for example a metal oxide. For example, the bond material may comprise (e.g. consist of) aluminium oxide, i.e. alumina ($Al_2O_3$).

The coating material may be a metal or a metal alloy. The metal may be a transition metal and/or the metal alloy may be a transition metal-based alloy. For example, the coating material may comprise (e.g. consist of) scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold and/or mercury. The coating material may comprise (e.g. consist of) an alloy comprising (e.g. based (i.e. predominantly) on) scandium, titanium, vanadium, chromium, manganese, iron, cobalt, nickel, copper, zinc, yttrium, zirconium, niobium, molybdenum, technetium, ruthenium, rhodium, palladium, silver, cadmium, lanthanum, hafnium, tantalum, tungsten, rhenium, osmium, iridium, platinum, gold and/or mercury.

The coating may comprise (e.g. consist of) nickel or a nickel-based alloy (e.g. a nickel-based superalloy such as an Inconel® or Renee alloy).

The coating material may comprise (e.g. consist of) a superalloy, for example a nickel-based, iron-based or cobalt-based superalloy.

In some examples: the body material is cast iron (e.g. grey cast iron); the bond material comprises (e.g. consists of) a metal or metal alloy (for example, cobalt or a cobalt-based alloy (e.g. a cobalt-chromium (Co—Cr) alloy or a cobalt-chromium-tungsten (Co—Cr—W) alloy), or titanium or a titanium-based alloy (e.g. a titanium-aluminium-vanadium (Ti—Al—V) alloy such as Ti-6Al-V)) or a ceramic such as a metal oxide (e.g. alumina ($Al_2O_3$)); and the coating material comprises (e.g. consists of) nickel or a nickel-based alloy (e.g. a nickel-based superalloy such as an Inconel® or Rene® alloy).

In some examples: the body material is cast iron (e.g. grey cast iron); the bond material comprises (e.g. consists of) a cobalt-based alloy (e.g. a cobalt-chromium (Co—Cr) alloy or a cobalt-chromium-tungsten (Co—Cr—W) alloy); and the coating material comprises (e.g. consists of) nickel or a nickel-based alloy (e.g. a nickel-based superalloy such as an Inconel® or Rene® alloy).

In some examples: the body material is cast iron (e.g. grey cast iron); the bond material comprises (e.g. consists of) titanium or a titanium-based alloy (e.g. a titanium-aluminium-vanadium (Ti—Al—V) alloy such as Ti-6Al-V)); and the coating material comprises (e.g. consists of) nickel or a nickel-based alloy (e.g. a nickel-based superalloy such as an Inconel® or Rene® alloy).

In some examples: the body material is cast iron (e.g. grey cast iron); the bond material comprises (e.g. consists of) a ceramic such as a metal oxide (e.g. alumina ($Al_2O_3$)); and the coating material comprises (e.g. consists of) nickel or a nickel-based alloy (e.g. a nickel-based superalloy such as an Inconel® or Rene® alloy).

It may be that the bond coating is no less than about 0.1 mm thick, for example, no less than about 0.5 mm thick. It may be that the bond coating is no greater than about 2 mm thick, for example no greater than about 1 mm thick. It may be that the bond coating is from about 0.1 mm to about 2 mm thick, for example from about 0.1 mm to about 1 mm thick, or from about 0.5 mm to about 2 mm thick, or from about 0.5 mm to about 1 mm thick.

It may be that the top coating is no less than about 0.5 mm thick, for example, no less than about 2 mm thick, or no less than about 5 mm thick. It may be that the top coating is no greater than about 1 cm thick, for example, no greater than about 5 mm thick, or no greater than about 3 mm thick. It may be that the top coating is from about 0.5 mm to about 1 cm thick, for example, from about 0.5 mm to about 5 mm thick, or from about 0.5 mm to about 3 mm thick, or from about 2 mm to about 1 cm thick, or from about 2 mm to about 5 mm thick, or from about 2 mm to about 3 mm thick, or from about 5 mm to about 1 cm thick.

The skilled person will appreciate that, except where mutually exclusive, a feature described in relation to any one of the above aspects may be applied mutatis mutandis to any other aspect. Furthermore, except where mutually exclusive, any feature described herein may be applied to any aspect and/or combined with any other feature described herein.

DESCRIPTION OF THE DRAWINGS

Embodiments will now be described by way of example only, with reference to the Figures, in which.

DETAILED DESCRIPTION

Figure 1A:
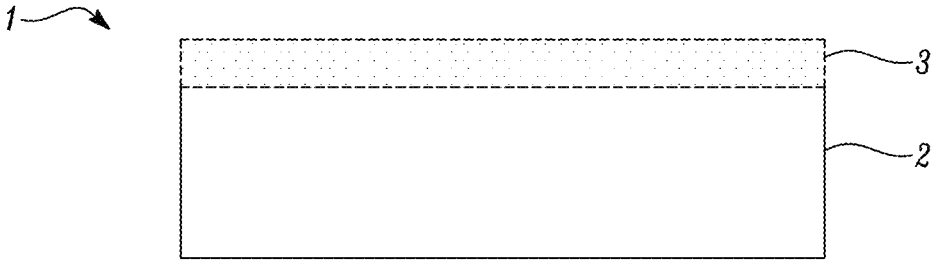
FIGS. 1 (*a*) to (*d*) illustrate schematically, in sectional side views, a process of repairing a damaged surface of an engine block by cold-spraying a coating including a bond coating and a top coating.
Figure 1B:
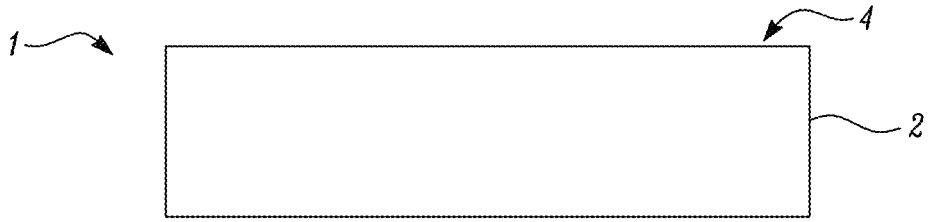
Figure 1C:
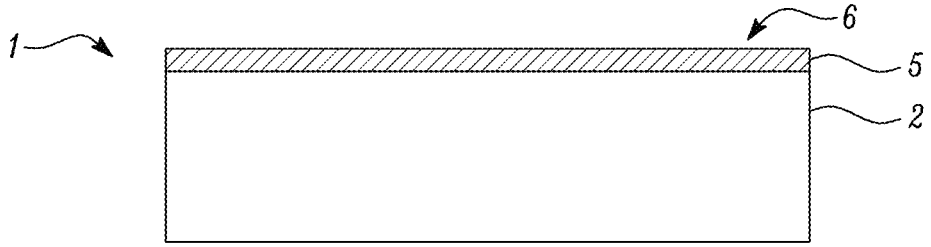
Figure 1D:
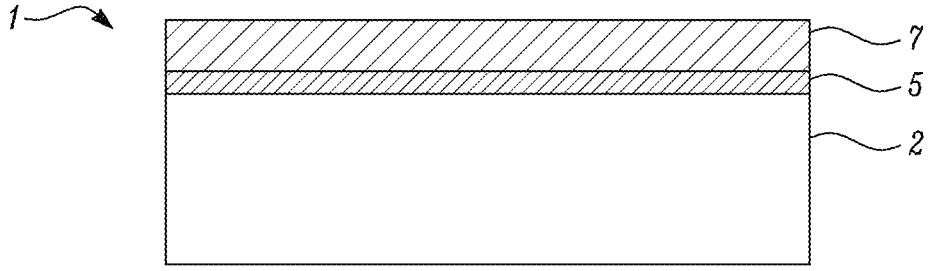

A method of repairing a diesel engine block 1 is illustrated schematically by way of FIGS. 1 (*a*) to (*d*).

The engine block 1 includes an engine block body 2 formed predominantly from grey cast iron. As shown in FIG. 1 (*a*), a surface portion 3 of the engine block 1 has been damaged through use, for example by cavitation erosion and wear. Repair of the engine block 1 to remove the damaged surface portion 3, and subsequently to achieve dimensional restoration, is necessary.

The damaged surface portion 3 of the engine block 1 may be removed by any suitable methods known in the art. For example, the damaged surface portion 3 may be removed using milling, grinding, sand blasting and/or polishing processes. Removal of the damaged surface portion 3 results in the formation of a new surface 4 of the engine block body 2, as can be seen in FIG. 1 (*b*).

Following removal of the damaged surface portion 3, dimensional restoration of the engine block 1 is achieved by cold-spray coating the engine block body 2.

In a first cold-spraying step, as illustrated in FIG. 1 (*c*), a bond coating 5 is formed on the surface 4 by cold-spraying a bond material onto the surface 4. In the present example, the bond material is a cobalt-chromium-tungsten (Co—Cr—W) alloy. The bond coating 5 is from about 0.5 mm to about 1 mm thick (i.e. measured in a direction locally perpendicular to the surface 4 of the engine block body) and has an external surface 6.

In a second cold-spraying step, as illustrated in FIG. 1 (*d*), a top coating 7 is formed on the surface 6 of the bond coating by cold-spraying a coating material onto the surface 6. In the present example, the coating material is a nickel-based superalloy (e.g. an Inconel® alloy). The top coating 7 is from about 2 mm to about 3 mm thick (i.e. measured in a direction locally perpendicular to the surface 4 of the engine block body).

Following the second cold-spraying step, a heat treatment is performed in which the engine block is held at a temperature of about 500° C. for about 4 hours.

As discussed in more detail below under Examples, the inventors have found that cold-spraying the bond material to form the bond coating on the engine block body, prior to cold-spraying the coating material to form the top coating, results in improved adhesion of the top coating to the engine block body in comparison to cold-spraying the coating material directly onto the engine block body (e.g. directly onto surface 4 formed by removal of the damaged portion 3). The inventors have also found that heat-treating the coated engine block leads to a further improvement in coating adhesion.

Figure 2:
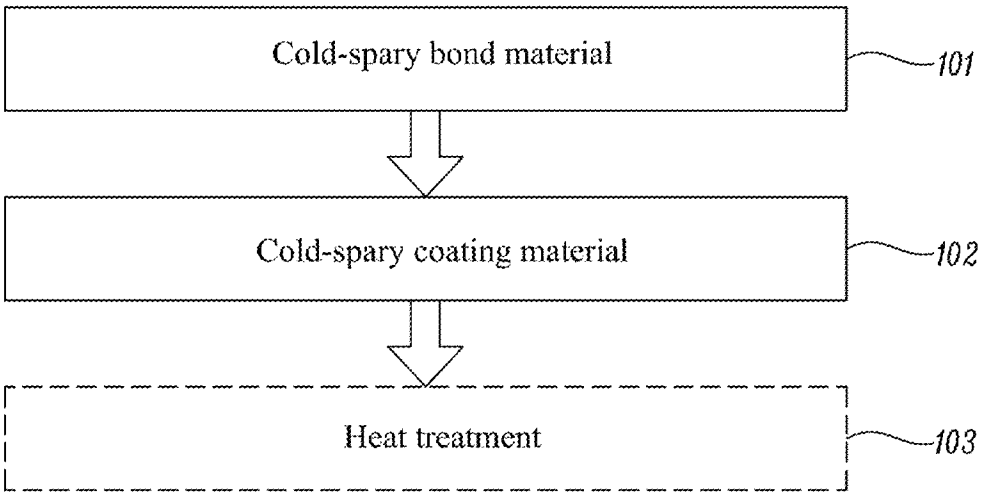
FIG. 2 is a flowchart illustrating a cold-spraying method.

Although the example shown in FIG. 1 relates to repair of an engine block, similar methods may be used to repair other types of component (such as other types of vehicle or engine component). More generally, similar methods may be used to form coatings on substrates of any type. In each case, however, the method includes (as illustrated schematically in FIG. 2): first, cold-spraying a bond material to form a bond coating (block 100 in FIG. 2); and, second, cold-spraying a coating material to form a top coating on the bond coating (block 101 in FIG. 2). The method may further comprise carrying out an optional heat treatment (block 102 in FIG. 3).

The substrate (e.g. the component) which is to be repaired or coated may be formed from any type of material. However, the inventors have found that the use of a cold-sprayed bond coating is particularly effective in improving adhesion of a cold-sprayed top coating when the substrate comprises non-metallic, intermetallic, ceramic or oxide phases. Such phases may be present in substrates formed from metals or metal alloys, for example as metal oxide surface coatings or as non-metallic, intermetallic, ceramic or oxides phases in an alloy microstructure also including predominantly metallic phases. For example, ferrous alloys, and in particular cast irons, may include phases such as graphite (e.g. in grey cast iron) or cementite (e.g. in white cast iron) which may be characterised as non-metallic, intermetallic or ceramic.

It will be appreciated that different bond materials may be selected for different applications. However, the inventors have found that the bond material should be harder than the material from which the substrate is formed, in order to achieve good adhesion between the bond coating and the substrate. In particular, the Vickers hardness of the bond material should be about 100 HV, for example about 150 HV, higher than the Vickers hardness of the surface of the substrate to be cold-sprayed. Suitable bond materials include metals or metal alloys (such as Co- or Ti-based alloys) or ceramics (such as alumina).

It will also be appreciated that different coating materials may be selected for different applications. In many applications, however, the coating material will be a metal or a metal alloy. The inventors have found that the method is particularly suitable for coating substrates with superalloys such as nickel-based superalloys (e.g. an Inconel® alloy).

It will also be appreciated that the cold-spraying conditions (for example, cold-spray apparatus parameters) may be varied dependant on the materials to be deposited and the thickness of the coatings to be obtained. Exemplary cold-spray parameters are provided below under Examples.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

EXAMPLES

Example 1

A grey cast iron engine block was repaired by machining away a damaged portion of a surface of the block and subsequently cold-spraying the machined surface of the block with a layer of Inconel® (IN718) nickel-based superalloy.

Figure 3:
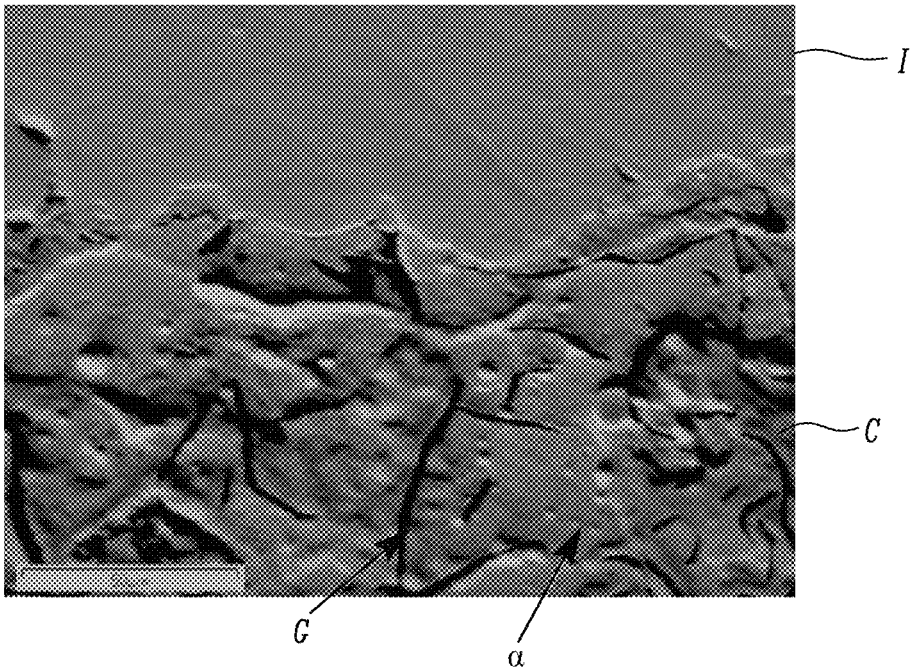
FIG. 3 is an optical micrograph of a ground, polished and etched metallurgical sample of an interface between a cast iron substrate and a cold-sprayed coating of nickel-based superalloy.
Figure 4:
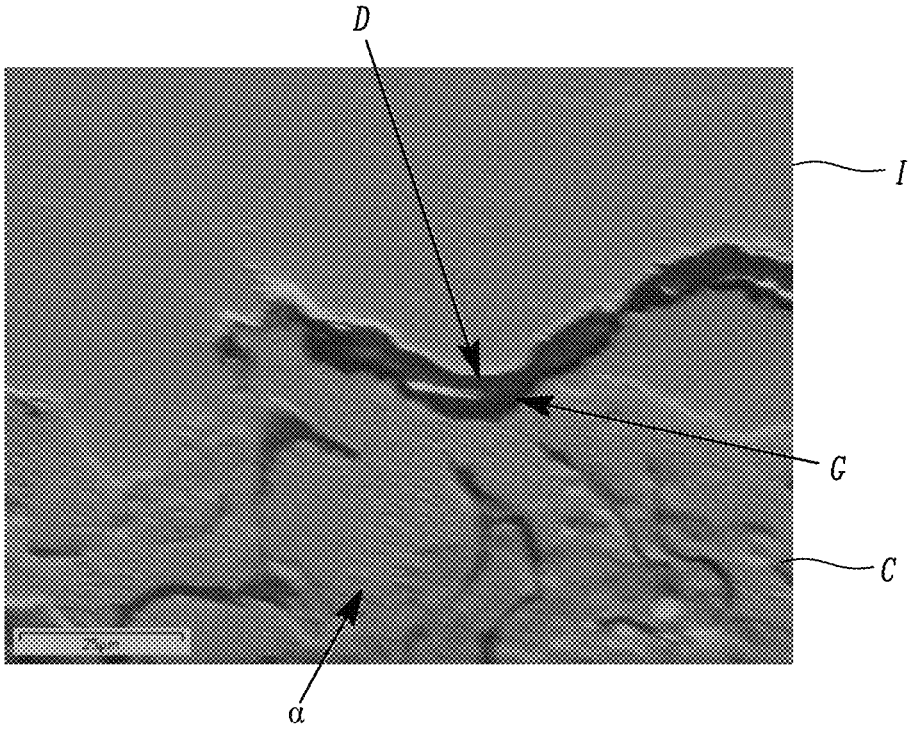
FIG. 4 is an optical micrograph of a ground, polished and etched metallurgical sample of an interface between a cast iron substrate and a cold-sprayed coating of nickel-based superalloy.

The microstructure of the engine block and the cold-sprayed layer, at the interface between the block and the layer, was investigated by imaging a metallurgical sample cut in cross-section perpendicular to the interface. The sample was ground, polished and etched according under standard metallurgical sampling conditions and was imaged in an optical microscope. FIGS. 3 and 4 are optical micrographs of the interface.

In both FIGS. 3 and 4, a region of grey cast iron is indicated generally at C and a region of Inconel® nickel-based superalloy is indicated generally at I. As can be seen in the micrographs, the cast iron includes a ferrite matrix, labelled α, and flakes of graphite, G. As can be seen in FIG. 3, the Inconel® nickel-based superalloy appears to bond well to the ferrite matrix of the cast iron. However, as can be seen in FIG. 4, the Inconel® nickel-based superalloy does not bond well to graphite flakes and, indeed, delamination (labelled D) of the Inconel® nickel-based superalloy layer adjacent interfacial graphite flakes is observed.

The strength of the bond between the layer of nickel-based superalloy and the grey cast iron substrate, as tested by a glue failure method, was found to be poor.

Example 2

A sample was prepared by cold-spraying a substrate with a bond material to form a bond coating and subsequently cold-spraying the bond coating with a coating material to form a top coating.

The substrate was formed from a grey cast iron (GJL 250).

The bond material was a Co—Cr—W alloy (Co452). The bond material was cold-sprayed using the following cold-spraying parameters:

Propellant Gas: $N_2$
Gas Temperature: 1000° C.
Gas Pressure: 45 bar
Particle Speeds: 700-800 m/second
Gas Flow: 80 $m^3$/hour
Gun Scan Speed: 500 mm/second
Step Size: 1 mm The coating material was an Inconel® (IN718) nickel-based superalloy. The coating material was cold-sprayed using the following cold-spraying parameters:

Propellant Gas: $N_2$
Gas Temperature: 800° C.
Gas Pressure: 40 bar
Particle Speeds: 600-700 m/second
Gas Flow: 80 $m^3$/h
Gun Scan Speed: 500 mm/second
Step Size: 3 mm In both cases, a standoff distance between the cold-spray gun nozzle and the substrate was 30 mm and a SIC de Laval nozzle having an inlet diameter of 13 mm, a throat diameter of 2.52 mm, an outlet diameter of 6 mm, an expansion ratio of 5.6, and a convergent length of 15 mm, was used.

The cast iron substrate was preheated to 300° C. for 5 minutes prior to cold spraying the bond material. The substrate was not preheated prior to cold spraying the coating material.

Figure 5:
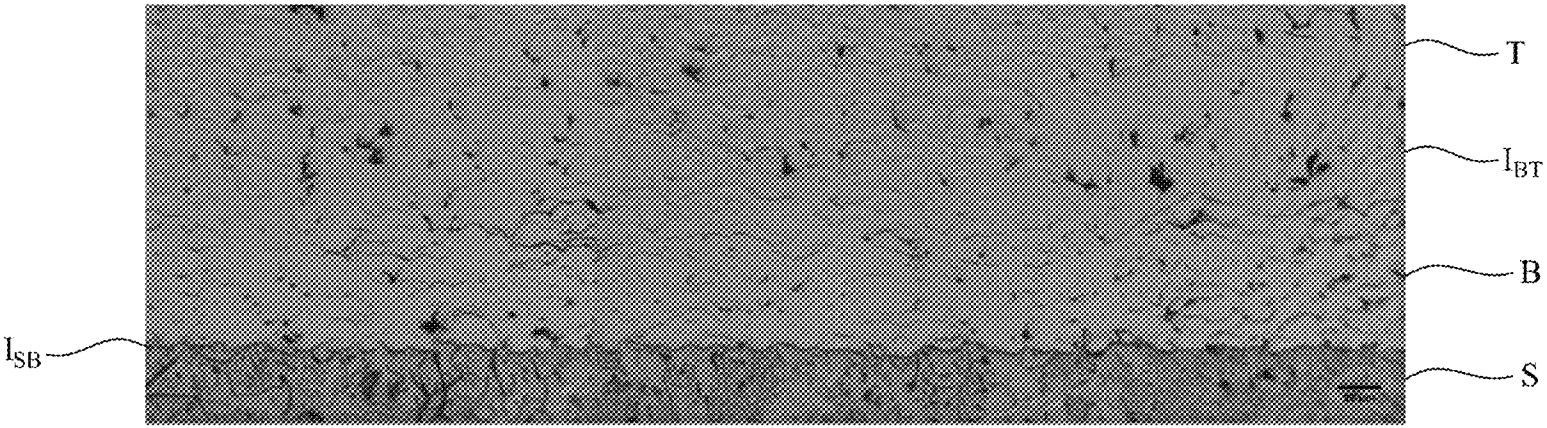
FIG. 5 is an optical micrograph of a ground, polished and etched metallurgical sample through a cast iron substrate coated with a cold-sprayed bond coating of cobalt-chromium-tungsten alloy and a top coating of nickel-based superalloy.
Figure 7:
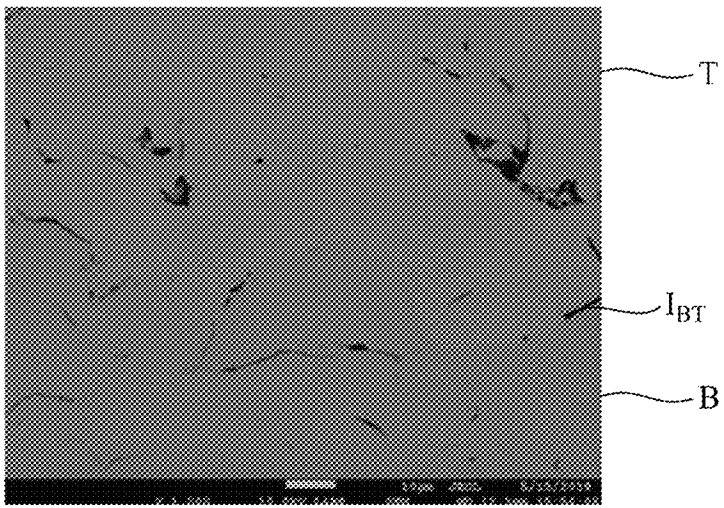
FIG. 7 is an optical micrograph of a ground, polished and etched metallurgical sample of an interface between a cold-sprayed bond coating of cobalt-chromium-tungsten alloy and a top coating of nickel-based superalloy.
Figure 6:
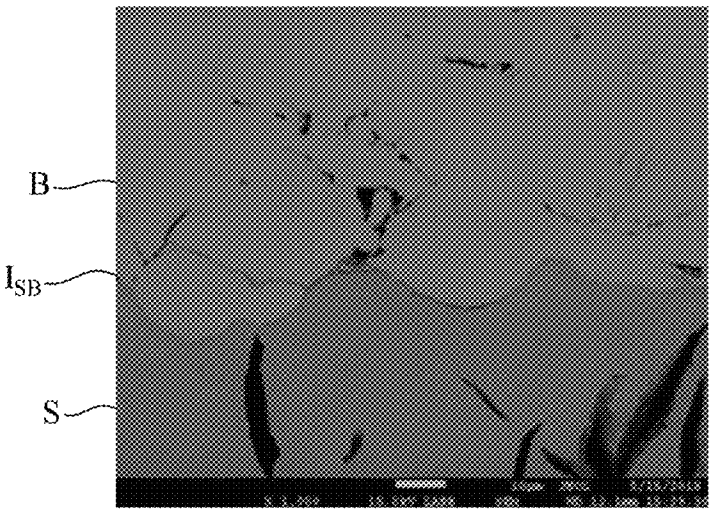
FIG. 6 is an optical micrograph of a ground, polished and etched metallurgical sample of an interface between a cast iron substrate coated and a cold-sprayed bond coating of cobalt-chromium-tungsten alloy.

FIG. 5 shows an optical micrograph of a ground, polished and etched cross-section through the sample perpendicular to the interfaces between the substrate, the bond coat and the top coat. As can be seen in the micrographs, the Co—Cr—W alloy bond coating, B, is well-adhered to the cast iron substrate, S, and the nickel-based superalloy top coating, T, is well-adhered to the bond coating, B. The substrate-bond coating ($I_{SB}$) and bond coating-top coating ($I_{BT}$) interfaces are shown in more detail in FIGS. 6 and 7, respectively. No continuous crack is observed along the substrate-bond coating interface or along the bond coating-top coating interface.

The strength of the bond between the coating (comprising the bond coating and the top coating) and the cast iron substrate, as tested by a glue failure method, was found to be improved in comparison to the sample in Example 1.

Example 3

Five different samples were prepared as follows.

Samples A, B and C were prepared by cold-spraying a nickel-based superalloy (Inconel® 625) onto a cast iron substrate. In sample A, the substrate was formed from a ductile cast iron and was sandblasted prior to cold-spraying. In sample B, the substrate was formed from a grey cast iron and was polished prior to cold-spraying. In sample C, the substrate was formed from a grey cast iron and was ground prior to cold-spraying.

Samples D and E were prepared by, first, cold-spraying a cast iron substrate with a bond material to form a bond coating and, second, cold-spraying the bond coating with a coating material to form a top coating. In sample D, the substrate was formed from grey cast iron, the substrate was polished prior to cold-spraying, the bond material was a Co—Cr—W alloy (Co452), and the coating material was a nickel-based superalloy (Inconel® 625). In sample E, the substrate was formed from grey cast iron and was polished prior to cold-spraying, the bond material was a Co—Cr—W alloy (Co452), the coating material was a nickel-based superalloy (Inconel® 625), and the sample was heat-treated by holding at 500° C. for 4 hours.

Figure 8:
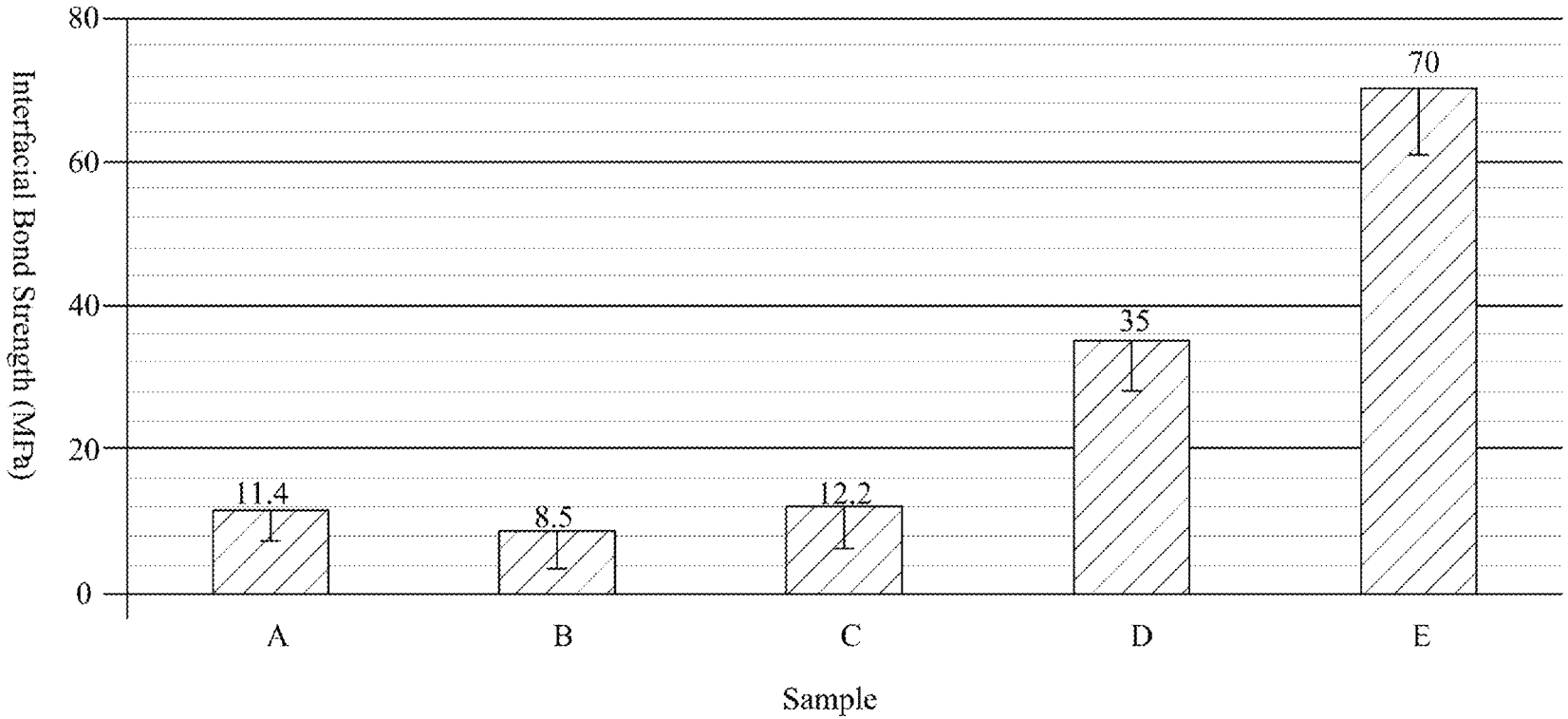
FIG. 8 is a bar chart showing interfacial bond strength (in MPa), measured by a glue failure method, of cold-sprayed samples A, B, C, D and E.

The interfacial bond strength for each sample was measured using the adhesion strength test (also known as the glue failure test) following the ASTM C633 standard. The samples were wire-cut into circular buttons each having a diameter of 25 mm. The buttons were ground flat. Top and bottom button surfaces and fixtures were sand-blasted with P80 alumina particles, cleaned with ethanol, and assembled together with adhesive glue. The assembled sets were then placed in an oven in which the sets were cured at 150° C. for 60 minutes and left to cool to room temperature (about 23° C.). The sets were then tested using a tensile tester with a load cell of 50 kN in tensile mode with an extension rate of 0.8 mm/minute until the sets failed. The results of the adhesion strength testing are shown in FIG. 8. As can be seen in FIG. 8, samples D and E (which include a bond coating between the layer of nickel-based superalloy and the cast iron substrate) exhibit improved interfacial bond strengths in comparison to samples A, B and C (in which nickel-based superalloy was cold-sprayed directly onto the cast iron substrate). In addition, it can be seen that the interfacial bond strength of sample E (which was subjected to a heat treatment after cold spraying) is twice that of sample D (which was not heat treated).

We claim:

1. A method comprising the steps of:

cold-spraying a surface of a substrate with a bond material to form a bond coating;

cold-spraying a surface of the bond coating with a coating material to form a top coating; and heating the coated substrate after forming the top coating;

wherein the substrate comprises a material comprising a non-metallic, intermetallic, ceramic or oxide phase; the bond material comprises cobalt, a cobalt-based alloy, titanium, or a titanium-based alloy; the coating material comprises nickel or a nickel-based alloy; the bond material is different from the coating material and harder than both of the top coating and the surface of the substrate; and wherein a difference between a Vickers hardness of the bond material and a Vickers hardness of the surface of the substrate is at least 100 HV when measured under the same conditions.

2. The method of claim 1, wherein the coating material is a nickel-based superalloy.

3. The method of claim 1, wherein heating the coated substrate comprises heating the coated substrate for at least 30 minutes.

4. The method of claim 1, wherein heating the coated substrate comprises holding the coated substrate at a temperature from about 200° C. to about 1000° C.

5. The method of claim 1, wherein the method further comprises mechanically preparing the surface of the substrate prior to forming the bond coating.

6. The method of claim 1, wherein the substrate is a structural component.

7. The method of claim 1, wherein the bond coating is from about 0.1 millimeter (mm) to about 2 mm thick.

8. The method of claim 1, wherein the top coating is from about 0.5 millimeter (mm) to about 1 mm thick.

9. The method of claim 3, wherein heating the coated substrate comprises heating the coated substrate for at least 2 hours.

10. The method of claim 9, wherein heating the coated substrate comprises heating the coated substrate for at least 4 hours.

11. The method of claim 1, further comprising mechanically preparing the surface of the substrate by milling or grinding prior to forming the bond coating.

12. The method of claim 1, wherein the substrate is an engine block.

13. The method of claim 9, wherein heating the coated substrate comprises heating the coated substrate at a temperature of about 500° C.

* * * * *